United States Patent [19]

Davis et al.

[11] Patent Number: 4,796,302

[45] Date of Patent: Jan. 10, 1989

[54] FINGER AND THUMB PROTECTOR

[76] Inventors: Charles L. Davis, c/o George Spector, 233 Broadway RM 3815; George Spector, 233 Broadway RM 3815, both of New York, N.Y. 10007

[21] Appl. No.: 115,836

[22] Filed: Nov. 2, 1987

[51] Int. Cl.[4] ..... A41D 19/00

[52] U.S. Cl. ..... 2/21

[58] Field of Search ..... 2/21

[56] References Cited

U.S. PATENT DOCUMENTS

| | | | |
|---|---|---|---|
| 48,354 | 6/1865 | Asmus | 2/21 X |
| 126,565 | 5/1872 | Mitchell | 2/21 X |
| 1,306,442 | 6/1919 | Sansotta | 2/21 |
| 1,316,292 | 9/1919 | Fleming | 2/21 |
| 1,388,618 | 8/1921 | Stein et al. | 2/21 |
| 1,416,001 | 5/1922 | Detwiler | 2/21 |
| 1,483,595 | 2/1924 | Read | 2/21 X |
| 2,348,962 | 5/1944 | Davis | 2/21 X |

FOREIGN PATENT DOCUMENTS

| | | | |
|---|---|---|---|
| 0172852 | 4/1952 | Austria | 2/21 |

*Primary Examiner*—Louis K. Rimrodt

[57] ABSTRACT

A finger and thumb protector is provided and consists of a pair of sheaths pivotly hinged towards each other. The sheaths have depressions on inner sides thereof to grip a nail thus allowing a person to hammer the nail with the sheaths cushioning the blows from the hammer.

4 Claims, 1 Drawing Sheet

FINGER AND THUMB PROTECTOR

BACKGROUND OF THE INVENTION

The instant invention relates generally to thumb guards and more specifically it relates to a finger protector.

Numerous thumb guards have been provided in prior art that are adapted to prevent accidential injury to the thumb and fingers of the hand. For example, U.S. Pat. Nos. 2,348,962; 3,029,440 and 3,728,736 all are illustrative of such prior art. While these units may be suitable for the particular purpose to which they address, they would not be as suitable for the purposes of the present invention as heretofore described.

SUMMARY OF THE INVENTION

A primary object of the present invention is to provide a finger protector that will overcome the shortcomings of the prior art devices.

Another object is to provide a finger protector that is engineered to protect a person's fingers while they hammer a nail.

An additional object is to provide a finger protector that is worn on index finger and thumb which is designed to hold the nail securely therebetween and at the same time cushion the blows from the hammer.

A further object is to provide a finger protector that is simple and easy to use.

A still further object is to provide a finger protector that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
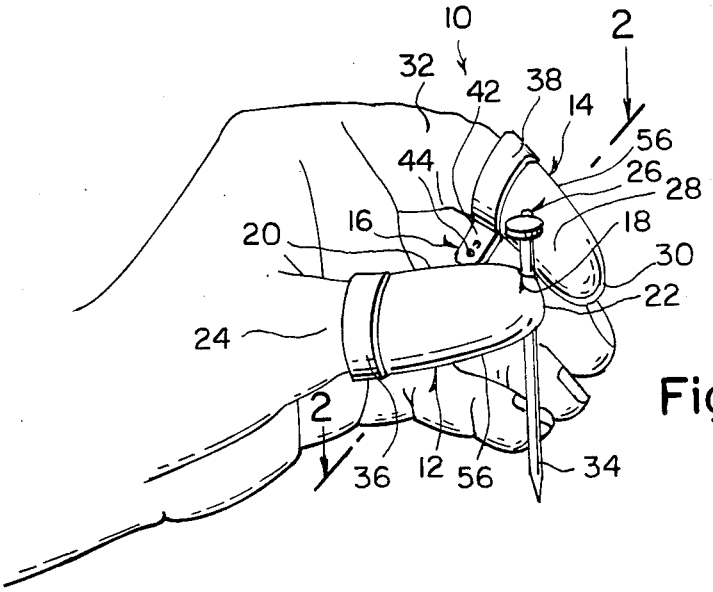
FIG. 1 is a perspective view of a hand with invention installed on thumb and index finger.
Figure 2:
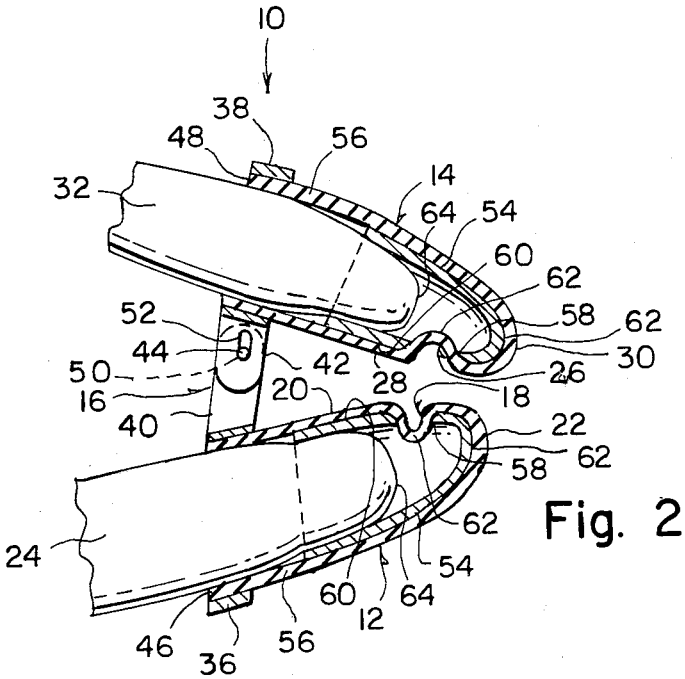
FIG. 2 is an enlarged cross sectional view taken along line 2—2 in FIG. 1.

Turning now descriptively to the drawings, in which similar reference characters denote similar elements throughout the several views, FIGS. 1 and 2 illustrate a finger protector 10 consisting of a pair of sheaths 12 and 14 and a hinge mechanism 16. The first sheath 12 has a depression 18 on inner side 20 near tip end 22 thereof. The first sheath 12 is of a size to fit over thumb 24 of a person. The second sheath 14 has a depression 26 on inner side 28 near tip end 30 thereof. The second sheath 14 is of a size to fit over index finger 32 of the person. The hinge mechanism 16 is for pivoting the sheaths 12 and 14 towards each other so that a nail 34 can be gripped between the depressions 18 and 26 allowing the person to hammer the nail 34 with the sheaths 12 and 14 cushioning the blows from the hammer.

The hinge mechanism 16 includes a pair of bands 36 and 38, a pair of arms 40 and 42 and a pivot pin 44. The first band 36 extends around open end 46 of the first sheath 12 and the second band 38 extends around open end 48 of the second sheath 14. The first arm 40 extends outwardly from the first band 36 and has an aperture 50 therein. The second arm 42 extends outwardly from the second band 38 and has an oversized aperture 52 therein. The pivot pin 44 extends through the aperture 50 in the first arm 40 and through the oversized aperture 52 in the second arm 42 thus allowing the sheaths 12 and 14 to pivot towards each other.

Each of the sheaths 12 and 14 includes a rigid inner sleeve 54 and a flexible outer sleeve 56. The inner sleeve 54 has a slot 58 on inner side 60 near tip end 62 thereof. The outer sleeve 56 fits over the inner sleeve 54 so that a portion 62 of the outer sleeve will enter the slot 58 forming the depression 18, 26.

The inner sleeve 54 and the outer sleeve 56 are elongated and sized so that a portion of the sheath 12, 14 having the depression 18, 26 ill extend past tip 64 of the thumb 24, index finger 32 thus decreasing the blows from the hammer to accidentially strike the thumb 24, index finger 32 of the person.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A finger protector which comprises:

(a) a pair of longitudinal sheaths, said first sheath having a depression on inner side near tip end thereof, said first sheath being of a size to fit over thumb of a person and said second sheath having a depression on inner side near tip end thereof, whereby said depressions are adapted to hold and guide a nail for being driven by a hammer when said depressions are in close proximity, said second sheath being of a size to fit over the index finger of the person;

(b) means pivotaly connecting said sheaths between said depressions and the joint connecting the finger and thumb whereby said sheaths are movable from an open position to a closed position with said depressions are in close proximity for holding and guiding said nail; and (c) said sheaths having cavities at said tip ends.

2. A finger protector as recited in claim 1, wherein said means include:

(a) a pair of bands, said first band extending around an open end of said first sheath and a second band extending around an open end of said second sheath;

(b) a pair of arms parallel to the longitudinal sheath axis; said first arm extending outwardly from said first band, said first arm having an aperture therein and said second arm extending outwardly from said first band, said first arm having an aperture therein and said second arm extending outwardly from said second band having an oversized aperture therein; and, wherein said apertures are transverse to said arms; and (c) a pivot pin transverse to said arms extending through said aperture in said first arm and through said oversized aperture in said second arm thus allowing said sheaths to pivot towards and away from each other due to one of said apertures being oversized.

3. A finger protector as recited in claim 2, wherein each of said sheaths further includes:

(a) rigid inner sleeve having a slot on inner side near tip end thereof; and (b) a flexible outer sleeve fitted over said inner sleeve having a depressed portion that protrudes into said slot forming said depression.

4. A finger protector as recited in claim 3, wherein each said inner and outer sleeves are elongated to extend longitudinally outward of the tips of said index finger and thumb providing a cavity outward of said thumb and index finger, whereby each said depression is located outward of thumb and index finger for protection from an errant hammer blow.

* * * * *